US008201905B2

(12) United States Patent
Suzuki et al.

(10) Patent No.: US 8,201,905 B2
(45) Date of Patent: Jun. 19, 2012

(54) HEAD DRIVE APPARATUS OF INK JET PRINTER, HEAD DRIVING METHOD, AND INK JET PRINTER

(75) Inventors: Toshiyuki Suzuki, Shiojiri (JP); Kunio Tabata, Shiojiri (JP); Osamu Shinkawa, Chino (JP); Tomoki Hatano, Higashiomi (JP); Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 677 days.

(21) Appl. No.: 12/161,900

(22) PCT Filed: Jan. 25, 2007

(86) PCT No.: PCT/JP2007/050987

§ 371 (c)(1),
(2), (4) Date: Jul. 23, 2008

(87) PCT Pub. No.: WO2008/086375

PCT Pub. Date: Aug. 2, 2007

(65) Prior Publication Data

US 2009/0033698 A1 Feb. 5, 2009

(30) Foreign Application Priority Data

Jan. 25, 2006 (JP) ..... 2006-016082

(51) Int. Cl.
*B41J 29/38* (2006.01)

(52) U.S. Cl. ..... 347/10; 347/5; 347/9; 347/11

(58) Field of Classification Search ..... 347/5, 9–11
See application file for complete search history.

(56) References Cited

U.S. PATENT DOCUMENTS 2,915,589 A 12/1959 Plant
4,254,439 A 3/1981 Fowler et al.
4,992,749 A 2/1991 Tokumo et al.
(Continued)

FOREIGN PATENT DOCUMENTS

EP 1594224 11/2005
(Continued)

OTHER PUBLICATIONS

U.S. Appl. No. 11/780,379, Mail Date Aug. 20, 2010, Final Office Action.

(Continued)

*Primary Examiner* — Ryan Lepisto
*Assistant Examiner* — Guy Anderson
(74) *Attorney, Agent, or Firm* — Maschoff Gilmore & Israelsen

(57) ABSTRACT

With an appropriate signal transmission form, a drive pulse output circuit is mounted to an ink jet head, so that waveform distortion of an actuator drive pulse for jet of ink drops is inhibited or prevented. Modulated signal data in memory is read to output a modulated signal, which is power-amplified by a digital power amplifier. The amplified digital signal is smoothed to be output to an actuator as a drive pulse. As a result, the digital power amplifier having high amplification efficiency efficiently amplifies the power of the modulated signal, thereby eliminating the need to use a cooling unit. The drive pulse output circuit can be mounted to the ink jet heads, thereby shortening the transmission path of an actuator drive pulse, which inhibits or prevents any waveform distortion of the drive pulse. The transmission of the modulated signal data DATA is implemented with a low frequency.

3 Claims, 8 Drawing Sheets

U.S. PATENT DOCUMENTS

| | | | | |
|---|---|---|---|---|
| 5,262,733 | A | 11/1993 | Nakajima et al. | |
| 5,283,658 | A | 2/1994 | Hayashi et al. | |
| 5,406,314 | A | 4/1995 | Kuehnle | |
| 5,475,405 | A | 12/1995 | Widder et al. | |
| 5,675,296 | A | 10/1997 | Tomikawa | |
| 5,894,314 | A | 4/1999 | Tajika et al. | |
| 6,133,844 | A | 10/2000 | Ahne et al. | |
| 6,267,519 | B1 | 7/2001 | Otsuki et al. | |
| 6,312,076 | B1 | 11/2001 | Taki et al. | |
| 6,312,096 | B1 | 11/2001 | Koitabashi et al. | |
| 6,320,605 | B1 | 11/2001 | Ikeda et al. | |
| 6,344,811 | B1 | 2/2002 | Melanson | |
| 6,364,443 | B1 | 4/2002 | Katano et al. | |
| 6,431,676 | B2 * | 8/2002 | Asauchi et al. | 347/10 |
| 6,443,547 | B1 | 9/2002 | Takahashi et al. | |
| 6,454,377 | B1 | 9/2002 | Ishizaki | |
| 6,457,794 | B1 | 10/2002 | Tajika et al. | |
| 6,474,762 | B2 | 11/2002 | Taki et al. | |
| 6,652,055 | B2 | 11/2003 | Oikawa | |
| 6,739,686 | B2 | 5/2004 | Imai | |
| 6,776,469 | B2 | 8/2004 | Nozawa | |
| 7,038,534 | B2 | 5/2006 | Hanzlik | |
| 7,083,274 | B2 | 8/2006 | Morita | |
| 7,111,755 | B2 | 9/2006 | Koyama et al. | |
| 7,170,544 | B2 | 1/2007 | Horiuchi | |
| 7,244,007 | B2 * | 7/2007 | Ishizaki | 347/5 |
| 7,252,355 | B2 | 8/2007 | Umeda | |
| 7,357,496 | B2 | 4/2008 | Silverbrook et al. | |
| 7,384,128 | B2 | 6/2008 | Sheahan et al. | |
| 7,571,989 | B2 * | 8/2009 | Ishizaki | 347/57 |
| 7,581,802 | B2 * | 9/2009 | Tabata et al. | 347/14 |
| 7,585,037 | B2 * | 9/2009 | Tabata et al. | 347/10 |
| 7,717,530 | B2 * | 5/2010 | Oshima | 347/11 |
| 7,731,317 | B2 | 6/2010 | Oshima | |
| 7,748,812 | B2 * | 7/2010 | Oshima | 347/11 |
| 2002/0113832 | A1 | 8/2002 | Kanematsu et al. | |
| 2002/0142733 | A1 | 10/2002 | Nishinakagawa | |
| 2002/0163458 | A1 * | 11/2002 | Jin | 341/152 |
| 2003/0112297 | A1 | 6/2003 | Hiratsuka et al. | |
| 2003/0231179 | A1 | 12/2003 | Suzuki | |
| 2004/0047477 | A1 | 3/2004 | Bank et al. | |
| 2004/0119770 | A1 | 6/2004 | Tamura | |
| 2004/0233241 | A1 | 11/2004 | Salacz | |
| 2005/0116977 | A1 | 6/2005 | Shinkawa et al. | |
| 2005/0231179 | A1 * | 10/2005 | Ishizaki | 323/234 |
| 2005/0248399 | A1 | 11/2005 | Kurokawa | |
| 2006/0132231 | A1 | 6/2006 | Ishii et al. | |
| 2006/0181342 | A1 | 8/2006 | Kanoh | |
| 2007/0079710 | A1 | 4/2007 | Ishizaki | |
| 2007/0120938 | A1 | 5/2007 | Fitzpatrick et al. | |
| 2007/0165074 | A1 | 7/2007 | Ishizaki | |
| 2008/0018683 | A1 | 1/2008 | Oshima et al. | |
| 2008/0018685 | A1 | 1/2008 | Tabata et al. | |
| 2008/0018686 | A1 | 1/2008 | Oshima et al. | |
| 2008/0018687 | A1 | 1/2008 | Tabata et al. | |
| 2008/0100652 | A1 | 5/2008 | Oshima et al. | |
| 2008/0186350 | A1 | 8/2008 | Oshima et al. | |
| 2008/0198191 | A1 | 8/2008 | Oshima | |
| 2008/0218545 | A1 | 9/2008 | Oshima et al. | |
| 2009/0066739 | A1 | 3/2009 | Tabata et al. | |
| 2009/0140780 | A1 | 6/2009 | Miyazaki et al. | |
| 2009/0174738 | A1 | 7/2009 | Oshima | |
| 2009/0213152 | A1 | 8/2009 | Tabata et al. | |
| 2009/0267979 | A1 | 10/2009 | Tabata et al. | |
| 2009/0289980 | A1 | 11/2009 | Tabata et al. | |
| 2009/0303271 | A1 * | 12/2009 | Tabata et al. | 347/10 |
| 2010/0091059 | A1 | 4/2010 | Oshima et al. | |
| 2010/0097419 | A1 | 4/2010 | Oshima | |
| 2010/0118078 | A1 | 5/2010 | Oshima et al. | |
| 2010/0188452 | A1 | 7/2010 | Oshima | |
| 2010/0220133 | A1 | 9/2010 | Oshima et al. | |
| 2011/0102486 | A1 | 5/2011 | Tabata et al. | |
| 2011/0109674 | A1 | 5/2011 | Oshima et al. | |

FOREIGN PATENT DOCUMENTS

| | | | |
|---|---|---|---|
| JP | 63-247059 | | 10/1988 |
| JP | 02-262705 | | 10/1990 |
| JP | 05-077456 | | 3/1993 |
| JP | 05-199044 | | 8/1993 |
| JP | 09-234865 | A | 9/1997 |
| JP | 09-300618 | A | 11/1997 |
| JP | 09-308264 | | 11/1997 |
| JP | 10-081013 | | 3/1998 |
| JP | 10-210757 | A | 8/1998 |
| JP | 11-058733 | A | 3/1999 |
| JP | 11-204850 | | 7/1999 |
| JP | 11-204850 | A | 7/1999 |
| JP | 2000-117980 | A | 4/2000 |
| JP | 200-245162 | | 9/2000 |
| JP | 2000-238262 | | 9/2000 |
| JP | 2001-121697 | | 5/2001 |
| JP | 2001-162794 | A | 6/2001 |
| JP | 2001-268922 | A | 9/2001 |
| JP | 2002-204595 | A | 7/2002 |
| JP | 2003-001824 | | 1/2003 |
| JP | 2003-237068 | | 8/2003 |
| JP | 2004-048886 | A | 2/2004 |
| JP | 2004-306434 | | 11/2004 |
| JP | 2005-035062 | | 2/2005 |
| JP | 2005-065068 | | 3/2005 |
| JP | 2005-075475 | | 3/2005 |
| JP | 2005-131928 | | 5/2005 |
| JP | 2005-322957 | | 11/2005 |
| JP | 2005-329710 | | 12/2005 |
| JP | 2005-349576 | A | 12/2005 |
| JP | 2006-025151 | | 1/2006 |
| JP | 2006-231882 | | 9/2006 |
| JP | 2006-256151 | | 9/2006 |
| JP | 2006-272907 | | 10/2006 |
| JP | 2006-304490 | A | 11/2006 |
| JP | 2007-069555 | | 3/2007 |
| JP | 2007-096364 | | 4/2007 |
| JP | 2007-144867 | | 6/2007 |
| JP | 2007-168172 | | 7/2007 |
| JP | 2007-190708 | | 8/2007 |
| JP | 2008-049698 | | 3/2008 |
| JP | 2008-049699 | | 3/2008 |
| JP | 2008-087467 | | 4/2008 |

OTHER PUBLICATIONS

U.S. Appl. No. 12/161,148, Mail Date Sep. 16, 2010, Final Office Action.
U.S. Appl. No. 12/161,201, Mail Date Sep. 28, 2010, Office Action.
U.S. Appl. No. 12/509,915, Mail date Sep. 30, 2010, Office Action.
U.S. Appl. No. 12/637,412, Mail Date Aug. 23, 2010, Office Action.
U.S. Appl. No. 12/752,367, Mail Date Oct. 8, 2010, Office Action.
U.S. Appl. No. 12/161,201, filed Jul. 17, 2008, Oshima et al.
U.S. Appl. No. 12/637,412, filed Dec. 14, 2009, Oshima et al.
U.S. Appl. No. 12/689,926, filed Jan. 19, 2010, Oshima et al.
U.S. Appl. No. 11/780,301, Mail Date Jun. 27, 2008, Office Action.
U.S. Appl. No. 11/780,301, Mail Date Feb. 20, 2009, Final Office Action.
U.S. Appl. No. 11/780,301, Mail Date Jun. 16, 2009, Notice of Allowance.
U.S. Appl. No. 11/780,357, Mail Date Oct. 28, 2009, Office Action.
U.S. Appl. No. 11/780,390, Mail Date Apr. 8, 2009, Notice of Allowance.
U.S. Appl. No. 11/849,582, Mail Date May 28, 2008, Office Action.
U.S. Appl. No. 11/849,582, Mail Date Dec. 30, 2009, Final Office Action.
U.S. Appl. No. 11/923,448, Mail Date Nov. 27, 2009, Office Action.
U.S. Appl. No. 12/752,367, filed Apr. 1, 2010, Oshima.
U.S. Appl. No. 11/780,357, Mail Date May 12, 2010, Final Office Action.
U.S. Appl. No. 11/849,582, Mail Date Apr. 19, 2010, Notice of Allowance.
U.S. Appl. No. 11/923,448, Mail Date Apr. 28, 2010, Final Office Action.
U.S. Appl. No. 11/780,379, Mail Date Mar. 3, 2010, Office Action.
U.S. Appl. No. 12/351,472, Mail Date Jan. 4, 2010, Notice of Allowance.
U.S. Appl. No. 12/340,940, Mail Date Apr. 12, 2010, Notice of Allowance.

U.S. Appl. No. 12/161,148, Mail Date Mar. 30, 2010, Office Action.
Notice of Allowance dated Jun. 14, 2011 as received in related U.S. Appl. No. 12/637,412.
Office Action dated Dec. 27, 2010 as received in related U.S. Appl. No. 12/026,129.
Office Action dated Jun. 14, 2011 as received in related U.S. Appl. No. 12/026,129.
Office Action dated Dec. 27, 2010 as received in related U.S. Appl. No. 12/027,175.
Office Action dated Jun. 15, 2011 as received in related U.S. Appl. No. 12/027,175.
European Search Report dated Jan. 28, 2010 received in European Application No. EP 07706915.1.
Office Action dated Mar. 4, 2011 as received in related U.S. Appl. No. 11/780,357.
Office Action dated Mar. 4, 2011 as received in related U.S. Appl. No. 11/780,379.
Office Action dated Nov. 30, 2010 as received in related U.S. Appl. No. 12/689,926.
Notice of Allowance dated Apr. 5, 2010 as received in related U.S. Appl. No. 11/972,542.
Notice of Allowance dated Dec. 17, 2010 as received in related U.S. Appl. No. 12/498,296.
U.S. Office Action dated Oct. 27, 2011 as received in U.S. Appl. No. 12/158,591.
JP Office Action dated Nov. 1, 2011 as received in application No. 2007-181649.
U.S Notice of Allowance dated Nov. 25, 2011 as received in U.S. Appl. No. 12/637,412.
US Office Action dated Jan. 9, 2012as received in U.S. Appl. No. 12/389,525.
US Notice of Allowance dated Jan. 13, 2012 as received in U.S. Appl. No. 12/161,201.
US Office Action dated Apr. 14, 2011 as received in U.S. Appl. No. 12/161,201.

* cited by examiner

HEAD DRIVE APPARATUS OF INK JET PRINTER, HEAD DRIVING METHOD, AND INK JET PRINTER

BACKGROUND

1. Technical Field

The present invention relates to a head drive apparatus of an ink jet printer in which a plurality of nozzles jet minute ink drops of liquid ink of a plurality of colors and particles of the ink (ink dots) are formed on a print medium to draw pre-determined characters and images, and a head driving method.

2. Related Art

An ink jet printer as in the above generally accomplishes low-cost and high-quality color printed material easily. As such, it is widely used not only in offices but also by general users along with popularization of a personal computer and a digital camera.

Generally, in such an ink jet printer, a moving part called a carriage, for example, integrally comprising ink cartridges and print heads (also called as ink jet heads) moves back and forth on a print medium in a direction crossing a direction to convey the medium, and nozzles of the print head jet (eject) liquid ink drops to form minute ink dots on the print medium. In this manner, pre-determined characters or images are drawn on the print medium to create desired printed material. The carriage comprises ink cartridges for four colors including black (and yellow, magenta, cyan) and a print head for each of the colors, so that not only monochrome print but also full color print in combination of the respective colors can be easily performed (further, print in six colors including the colors, light cyan and light magenta, seven colors, and eight colors are practically implemented).

In the above type of ink jet printer for executing print by moving the ink jet heads on the carriage back and forth in a direction crossing a direction to convey a print medium in the above manner, the ink jet heads must be moved back and forth about ten times or more than tens of times to neatly print a whole page.

On the other hand, in an ink jet printer comprising ink jet heads (do not need to be integrated) of the same length as the width of a print medium but not comprising a carriage, the ink jet heads do not need to be moved in a width direction of the print medium so that one-pass printing is possible, enabling quick printing similar to a laser printer. An ink jet printer in the former scheme is generally called a "multi-pass (serial) ink jet printer", while an ink jet printer in the latter scheme is generally called a "line head ink jet printer".

In such an ink jet printer, drive pulses are used to drive an actuator to change the pressure in a pressurizing chamber, so that the pressure change causes the ink in the pressurizing chamber to be jetted as ink drops through a nozzle which is in communication with the pressurizing chamber. There are several types of actuators, and for example, in a piezoelectric ink jet printer, an application of a drive pulse to a piezoelectric element which is an actuator causes a vibrating plate in contact with a pressurizing chamber to be displaced, which changes the pressure in the pressurizing chamber, and ink drops are jetted.

A method for generating a drive pulse is illustrated in FIG. 2 of JP-A-2004-306434. That is, data is read out from a memory for storing drive signal data, a D/A converter converts the data into analog data, and a drive signal is supplied to an ink jet head through a current amplifier. A circuit of the current amplifier comprises transistors in push-pull connection, as shown in FIG. 3 of the document, in which a linear drive amplifies a drive signal.

In this type of an ink jet printer, for reduction of printing time, simplification of a driving circuit, reduction of the number of signal lines, and the like, a common drive pulse is applied to actuators of a plurality of nozzles. In other words, the same drive pulses are simultaneously supplied to a plurality of actuators, and in this case, the plurality of actuators is connected in parallel to one drive pulse. The connected actuators are selected in response to nozzles through which ink drops are jetted, that is, in response to print data. It has become apparent that when the number of actuators connected to one drive pulse changes as described above, the characteristic of the jet of ink drops changes in accordance with the number of the connected actuators. Therefore, in an ink jet printer described in the following JP-A-2000-238262, the number of actuators (or nozzles) which are actually driven is acquired, and then in accordance with the number, a drive pulse itself for jetting ink drops is changed and set. Specifically, a voltage gradient of a drive pulse of a voltage signal having a trapezoidal waveform signal or a peak voltage itself thereof is changed so as to stabilize the characteristics of jet of ink drops.

SUMMARY

As described in the JP-A-2000-238262, the waveform distortion of a drive pulse which causes the characteristics change of the jet of ink drops is partly due to a parasitic impedance with respect to wiring. In order to reduce the parasitic impedance of a flexible wiring for connecting between a body of an ink jet printer and an ink jet head, a drive pulse output circuit for generating and outputting drive pulses can be mounted to the ink jet head so as to shorten a transmission path from the drive pulses output circuit to an actuator. However, the conventional ink jet printer in which a pair of transistors in push-pull connection amplifies the current of an actuator drive pulse has a problem that it has a so large cooling plate radiator therein that the drive pulses output circuit cannot be substantially mounted to an ink jet head.

The present invention was made in view of the above problems, and an object of the present invention is to provide a head drive apparatus of an ink jet printer which has an appropriate signal transmission form that allows a drive pulses output circuit to be mounted to an ink jet head, and is able to inhibit or prevent waveform distortion of an actuator drive pulse for jet of ink drops, and a head driving method.

[First Aspect]

To solve the above problems, a method for driving a head of an ink jet printer according to a first aspect of the present invention having a plurality of nozzles for jetting liquid drops that are provided for an ink jet head, and actuators provided in correspondence to the nozzles that includes a step of applying a drive pulse to the actuators, for outputting digital data of a modulated signal which is required to generate the drive pulse; storing the digital data of the modulated signal in a memory; creating and outputting a modulated signal based on the stored digital data of the modulated signal; amplifying the modulated signal using a digital power amplifier; and smoothing the amplified digital signal to be output to the actuators as a drive pulse.

[Second Aspect]

A head drive apparatus of an ink jet printer according to a second aspect of the present invention comprises a plurality of nozzles that jets liquid drops that are provided for an ink jet head, a plurality of actuators provided in correspondence to the nozzles, and a drive unit that applies a drive pulse to the actuators, in which the drive unit comprises a modulated signal data output circuit that outputs a modulated signal data which is required to generate the drive pulse, and a drive pulse output circuit that outputs a drive pulse to the actuators based on the modulated signal data output from the modulated signal data output circuit, wherein the drive pulse output circuit comprises a storage unit that stores the modulated signal data output from the modulated signal data output circuit, a modulated signal data read-write unit that outputs a modulated signal which is pulse modulated based on the modulated signal data stored in the storage unit, a digital power amplifier that power amplifies the modulated signal output from the modulated signal data read-write unit; and a low pass filter that smoothes the amplified digital signal power-amplified by the digital power amplifier to output the signal to the actuators as a drive pulse.

[Third Aspect]

A head drive apparatus of an ink jet printer according to a third aspect of the present invention for the head drive apparatus of an ink jet printer according to claim 2, in which the drive pulse output circuit is mounted to the ink jet head.

A method for driving a head of an ink jet printer and a head drive apparatus according to the above aspects, in which the method for outputting a modulated signal which is pulse modulated based on modulated signal data stored in a storage unit such as a memory, amplifying the modulated signal using a digital power amplifier, and smoothing the amplified digital signal to output the signal to the actuators as a drive pulse, thereby a modulated signal is efficiently power-amplified by a digital power amplifier having a high amplification efficiency, which eliminates a cooling unit such as a cooling plate radiator and enables a mount of a drive pulses output circuit to an ink jet head. This shortens a transmission path of an actuator drive pulse, and inhibits or prevents any waveform distortion of the drive pulse. The method also includes the method for outputting a modulated signal data required to generate a drive pulse and storing the modulated signal data in a memory, and creating and outputting a modulated signal based on the stored modulated signal data, thereby the transmission of modulated signal data can be performed at a low frequency prior to the creation and output of a drive pulse, and a drive pulses output circuit is mounted to the ink jet head so that an appropriate transmission form of a high frequency modulated signal can be provided.

BRIEF DESCRIPTION OF THE DRAWINGS

FIG. 1A is a top plain view, and 1B is a front view;

DESCRIPTION OF SYMBOLS

Figure 1A:
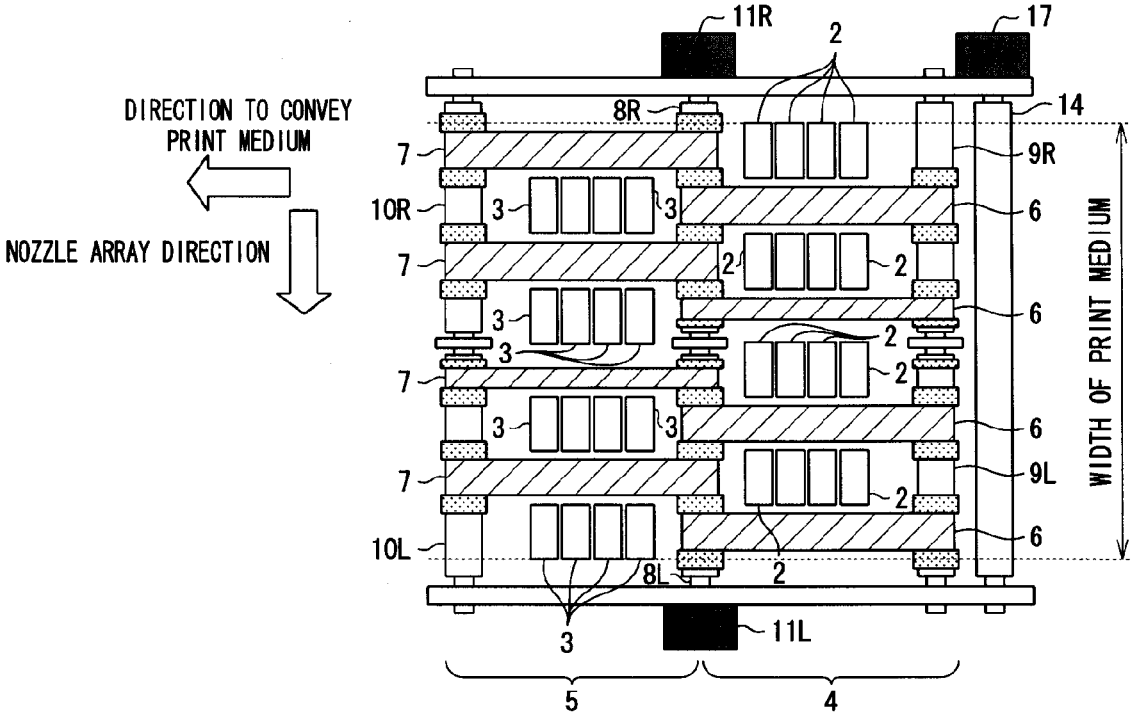
FIGS. 1A and 1B are the overall configuration diagrams showing a line head ink jet printer to which a head drive apparatus of the ink jet printer according to the present invention is applied.

1 print medium
2 first ink jet head
3 second ink jet head
4 first conveyor unit
5 second conveyor unit
6 first conveyor belt
7 second conveyor belt
8R and 8L drive rollers
9R and 9L first driven rollers
10R and 10L second driven rollers
11R and 11L electric motors
22 actuator
24 modulated signal data read-write unit
25 digital power amplifier
26 low pass filter
27 selector
28 drive pulses output circuit
29 memory
70 modulated signal data output circuit

DESCRIPTION OF EXEMPLARY EMBODIMENTS

A first embodiment of an ink jet printer according to the present invention will be described with reference to the drawings.

Figure 1B:
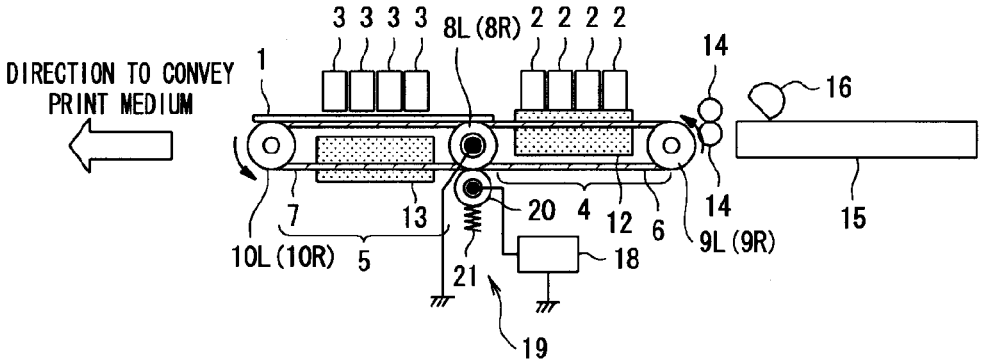

FIGS. 1A and 1B are the overall configuration diagrams of an ink jet printer according to this embodiment: FIG. 1A is a top plain view of the printer; and FIG. 1B is a front view of the printer. In FIGS. 1A and 1B, a print medium 1 is a line head ink jet printer that is conveyed in a direction from the right to the left indicated by the arrow in the figure and printed in a printing area on the way of the conveyor. However, the ink jet head according to the present embodiment is not arranged only at one place, but two ink jet heads are arranged at two places.

Reference numeral 2 in the figure denotes a first ink jet head being provided on the upstream side of the direction in which the print medium 1 is conveyed, and reference numeral 3 denotes a second ink jet head being provided on the downstream side of the direction. A first conveyor unit 4 is provided below the first ink jet heads 2 for conveying the print medium 1, while a second conveyor unit 5 is provided below the second ink jet heads 3. The first conveyor unit 4 includes four first conveyor belts 6 which are arranged with predetermined space therebetween in the direction crossing the direction in which the print medium 1 is conveyed (hereinafter, also referred to as a nozzle array direction), and the second conveyor unit 5 similarly includes four second conveyor belts 7 which are arranged with predetermined space therebetween in the direction (nozzle array direction) crossing the direction in which the print medium 1 is conveyed.

The four first conveyor belts 6 and the similar four second conveyor belts 7 are arranged alternately. This embodiment divides the conveyor belts into two of the first conveyor belts 6 and two of the second conveyor belts 7 on the left side in the nozzle array direction, and two of the first conveyor belts 6 and two of the second conveyor belts 7 on the right side in the nozzle array direction. That is, a right drive roller 8R is provided through an overlapping part of the two first conveyor belts 6 and the two second conveyor belts 7 on the right side in the nozzle array direction. A left drive roller 8L is provided through an overlapping part of the two first conveyor belts 6 and the two second conveyor belts 7 on the left side in the nozzle array direction. A first right driven roller 9R and a first left driven roller 9L are provided on the upstream side, while a second right driven roller 10R and a second left driven roller 10L are provided on the downstream side. The rollers are practically separated at the center part of FIG. 1A, though they seem to be continuous rollers. The two first conveyor belts 6 on the right side in the nozzle array direction are wound around the right drive roller 8R and the first right driven roller 9R, and the two first conveyor belts 6 on the left side in the nozzle array direction are wound around the left drive roller 8L and the first left driven roller 9L. The two second conveyor belts 7 on the right side in the nozzle array direction are wound around the right drive roller 8R and the second right driven roller 10R, the two second conveyor belts 7 on the left side in the nozzle array direction are wound around the left drive roller 8L and the second left driven roller 10L. The right drive roller 8R is connected to the right electric motor 11R, while the left drive roller 8L is connected to the left electric motor 11L. Therefore, when the right electric motor 11R rotates the right drive roller 8R, the first conveyor unit 4 having the two first conveyor belts 6 on the right side in the nozzle array direction and the second conveyor unit 5 similarly having the two second conveyor belts 7 on the right side in the nozzle array direction synchronize with each other and move at the same speed. When the left electric motor 11L rotates the left drive roller 8L, the first conveyor unit 4 having the two first conveyor belts 6 on the left side in the nozzle array direction and the second conveyor unit 5 similarly having the two second conveyor belts 7 on the left side in the nozzle array direction synchronize with each other and move at the same speed. However, if the right electric motor 11R and the left electric motor 11L rotate at different speeds, conveyor speeds on left and right sides in the nozzle array direction can be different from each other. Specifically, if the right electric motor 11R rotates faster than the left electric motor 11L, the conveyor speed of the right side in the nozzle array direction can be higher than that of the left side. If the left electric motor 11L rotates faster than the right electric motor 11R, the conveyor speed of the left side in the nozzle array direction can be higher than that of the right side.

The first ink jet heads 2 and the second ink jet heads 3 are arranged offset from each other in the direction in which the print medium 1 is conveyed for each of six colors of yellow (Y), magenta (M), cyan (C) and black (K). To the respective ink jet heads 2 and 3, ink is supplied from ink tanks (not shown) for the respective colors via ink supply tubes. Each of the ink jet heads 2 and 3 has a plurality of nozzles formed therein in the direction crossing the direction in which the print medium 1 is conveyed (i.e., the nozzle array direction). The nozzles simultaneously jet a necessary amount of ink drops to a necessary position to form and output minute ink dots on the print medium 1. This is performed for each color so that only one pass of the print medium 1 conveyed by the first conveyor unit 4 and the second conveyor unit 5 enables one-pass printing thereon. That is, the areas where the ink jet heads 2 and 3 are arranged correspond to printing areas.

A method for jetting and outputting ink from each nozzle of an ink jet head includes an electrostatic scheme, a piezoelectric ink jet, and a film-boiling ink jet. In the electrostatic scheme, an application of a drive signal to an electrostatic gap which functions as an actuator causes a displacement of a vibrating plate in a cavity and a pressure change in the cavity, which causes ink drops to be jetted and output from a nozzle. In the piezoelectric ink jet, an application of a drive signal to a piezoelectric element which functions as an actuator causes a displacement of a vibrating plate in a cavity and a pressure change in the cavity, which causes ink drops to be jetted and output from a nozzle. In the film-boiling ink jet, a micro heater in a cavity is instantaneously heated to a temperature of 300° C. or more, so as to cause a film-boiling state of ink and generate bubbles in the ink, resulting in a pressure change which causes ink drops to be jetted and output from a nozzle. The present invention can be applied to any of the above inkjet methods, but among them, is particularly preferable to a piezoelectric element since the amount of ink drop jet can be adjusted by controlling a peak voltage or a voltage gradient of a drive signal.

The ink drop jetting nozzles of the first ink jet heads 2 are formed only between the four first conveyor belts 6 of the first conveyor unit 4, while the ink drop jetting nozzles of the second ink jet heads 3 are formed only between the four second conveyor belts 7 of the second conveyor unit 5. This allows a cleaning unit which will be described below to clean the respective ink jet heads 2 and 3, but in this configuration, one-pass full-page printing cannot be accomplished only by either of the ink jet heads. Accordingly, in order to cover the areas where either of the ink jet heads cannot print, the first ink jet heads 2 and the second ink jet heads 3 are arranged offset from each other in the direction in which the print medium 1 is conveyed. Each of the nozzles has an independent actuator, and a selection switch is individually provided thereto, which will be explained later.

A first cleaning cap 12 for cleaning the first ink jet heads 2 is provided under the first ink jet heads 2, while a second cleaning cap 13 for cleaning the second ink jet heads 3 is provided under the second ink jet heads 3. Both of the cleaning caps 12 and 13 are formed to have a size which passes between the four first conveyor belts 6 of the first conveyor unit 4 and between the four second conveyor belts 7 of the second conveyor unit 5, respectively. The cleaning caps 12 and 13 individually include: a square cap body with a bottom that covers the nozzles formed in the bottom surfaces of the ink jet heads 2 and 3, i.e., the nozzle side surface, and can be adhered to the nozzle side surface; an ink absorber provided on the bottom thereof; a tube pump connected to the bottom of the cap body; and an elevator for moving up and down the cap body. Thus, the elevator moves up the cap body to adhere the body to each nozzle side surface of the ink jet heads 2 and 3. When the tube pump creates a negative pressure in the cap body as such, ink drops and bubbles are sucked up through the nozzles which are open in the nozzle side surface of the ink jet heads 2 and 3, which cleans the ink jet heads 2 and 3. When the cleaning is finished, the cleaning caps 12 and 13 are moved down. In some cases, a wiper is used to wipe the nozzle side surface to make the meniscus of each nozzle smooth (the meniscus means a liquid surface of ink).

On the upstream side of the first driven rollers 9R and 9L, a pair of gate rollers 14 are provided for controlling timing to feed the print medium 1 supplied from a paper feeder 15 and for correcting the skew of the print medium 1. The skew is torsion of the print medium 1 relative to the conveyor direction. A pickup roller 16 for supplying the print medium 1 is provided above the paper feeder 15. Reference numeral 17 in the figure denotes a gate roller motor for driving the gate rollers 14.

A belt charging unit 19 is provided below the drive rollers 8R and 8L. The belt charging unit 19 includes: a charging roller 20 contacting the first conveyor belts 6 and the second conveyor belts 7 across the drive rollers 8R and 8L; a spring 21 for pressing the charging roller 20 against the first conveyor belts 6 and the second conveyor belts 7; and a power source 18 for imparting electric charge to the charging roller 20, and the electric charge is imparted from the charging roller 20 to the first conveyor belts 6 and the second conveyor belts 7 for charging. Generally, when such a type of belt which includes a medium or high resistor or insulator is charged by the belt charging unit 19, the electric charge transfer to the surface thereof induces polarization to the print medium 1 which also includes a high resistor or insulator. The electrostatic force between electric charge generated by the induced polarization and electric charge of the belt surface allows the print medium 1 to be adsorbed to the belt. The charging unit may be a corotron which sprays charge.

Therefore, according to the ink jet printer, the belt charging unit 19 charges the surfaces of the first conveyor belts 6 and the second conveyor belts 7, and in the state, the gate rollers 14 feeds the print medium 1 to be pressed against the first conveyor belt 6 by a paper pressing roller which is configured with a spur or a roller (not shown). Then, the print medium 1 is adsorbed to the surface of the first conveyor belts 6 by the operation of the induced polarization described above. In this state, a rotation of the drive rollers 8R and 8L by the electric motors 11R and 11L causes the generated rotary drive force to be transmitted to the first driven rollers 9R and 9L via the first conveyor belts 6.

With the print medium 1 adsorbed as described above, the first conveyor belts 6 are moved downstream in the conveyor direction to cause the print medium 1 to be moved to a position under the first ink jet heads 2, so that ink drops are jetted through the nozzles formed in the first ink jet head 2 for printing. When the printing by the first ink jet heads 2 is finished, the print medium 1 is moved downstream in the conveyor direction to be transferred to the second conveyor belts 7 of the second conveyor unit 5. As described above, since the surfaces of the second conveyor belts 7 are also charged by the belt charging unit 19, the operation of the induced polarization described above causes the print medium 1 to be adsorbed to the surfaces of the second conveyor belts 7.

In this state, the second conveyor belts 7 are moved downstream in the conveyor direction to cause the print medium 1 to be moved to a position under the second ink jet head 3, so that ink drops are jetted through the nozzles formed in the second ink jet head for printing. When the printing by the second ink jet head is finished, the print medium 1 is further moved downstream in the conveyor direction to be separated from the surface of the second conveyor belts 7 by a separator (not shown) and jetted into a paper ejector.

If the first and second ink jet heads 2 and 3 need to be cleaned, as described above, the first and second cleaning caps 12 and 13 are moved upward to adhere the cap body to the nozzle side surface of the first and second ink jet heads 2 and 3. In that state, a negative pressure is created in the cap body to suck up ink drops and bubbles through the nozzles of the first and second ink jet heads 2 and 3 so as to clean the first and second ink jet heads 2 and 3. After the cleaning, the first and second cleaning caps 12 and 13 are moved downward.

Figure 2:
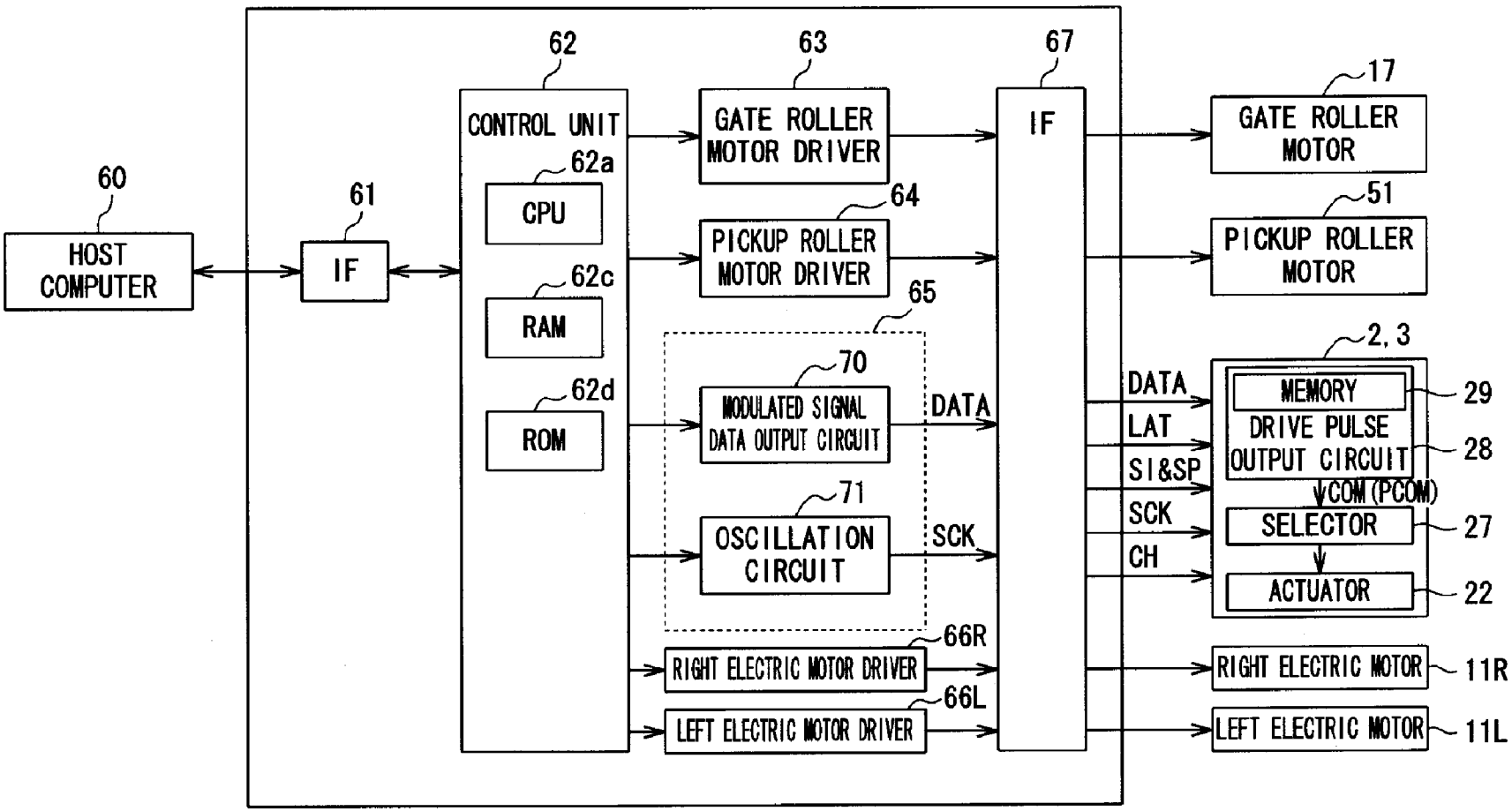
FIG. 2 is a block diagram of a control unit of the ink jet printer of FIGS. 1A and 1B.

The ink jet printer includes a control unit that controls the printer itself. The control unit processes printing on a print medium by controlling a print unit or a paper feed unit based on print data input from a host computer 60 such as a personal computer or a digital camera, as shown in FIG. 2. The control unit includes: an input interface 61 for receiving print data input from the host computer 60; a control unit 62 comprising a microcomputer for executing print processing based on the print data input from the input interface 61; a gate roller motor driver 63 for controlling drive of the gate roller motor 17; a pickup roller motor driver 64 for controlling drive of a pickup roller motor 51 for driving the pickup roller 16; a head driver 65 for controlling drive of the ink jet heads 2 and 3; a right electric motor driver 66R for controlling drive of the right electric motor 11R; a left electric motor driver 66L for controlling drive of the left electric motor 11L; and an interface 67 for converting an output signal from each of the drivers 63 to 65, 66R and 66L into a control signal used in the external gate roller motor 17, the pickup roller motor 51, the ink jet heads 2 and 3, the right electric motor 11R and the left electric motor 11L and outputting the signal.

The control unit 62 includes: a CPU (Central Processing Unit) 62*a* for executing various processing such as print processing; a RAM (Random Access Memory) 62*c* for temporally storing print data input via the input interface 61 or various data to execute processing to print the print data, or for temporally deploying an application program such as for print processing; and a ROM (Read-Only Memory) 62*d* comprising a non-volatile semiconductor memory for storing a control program executed by the CPU 62*a*. When the control unit 62 obtains print data (image data) from the host computer 60 via the interface 61, the CPU 62*a* executes pre-determined processing on the print data, outputs print data including which nozzle jets ink drops or how many ink drops are jetted, and outputs a control signal to each of the drivers 63 to 65, 66R and 66L based on the print data and input data from various sensors. When each of the drivers 63, 64, 66R and 66L except the head driver 65 outputs the control signal, the interface 67 converts the signal into a drive signal, which causes the gate roller motor 17, the pickup roller motor 51, the right electric motor 11R, and the left electric motor 11L to be individually actuated to execute paper feed and conveyor of the print medium 1, posture control of the print medium 1, and the like. The respective components of the control unit 62 are electrically connected to one another via a bus (not shown). A method for generating and outputting a drive signal (which is called a drive pulse in the present invention) to actuators corresponding to the plurality of nozzles of the ink jet heads 2 and 3 will be explained in detail later.

The head driver 65 includes a modulated signal data output circuit 70 which outputs modulated signal digital data DATA for creating a drive pulse PCOM, and an oscillation circuit 71 for outputting a clock signal SCK. The modulated signal data output circuit 70 outputs modulated signal digital data DATA from which a modulated signal corresponding to a pulse width modulated (PWM) signal is output when the data stored in a memory 29 is read out at a high speed by a modulated signal data read-write unit 24 which will be explained later. The modulated signal is converted into a drive pulse PCOM by a drive pulse output circuit 28 which will be explained later, and applied to an actuator 22 such as a piezoelectric element selected by a selector 27 in accordance with the drive pulse selection data SI&SP. The modulated signal digital data DATA is stored in a ROM 62*d* of the control unit 62 in advance.

Figure 3:
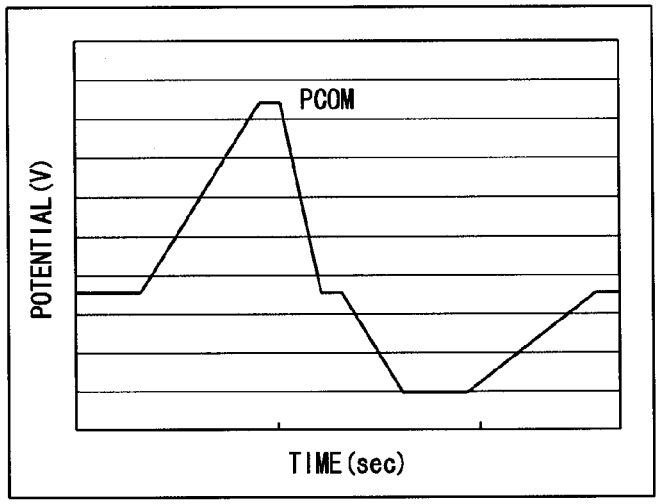
FIG. 3 is a block diagram of a drive pulse for driving an actuator.

The drive pulses PCOM supplied to an actuator 22 such as a piezoelectric element in the present invention has a waveform such as that shown in FIG. 3. A rise time of the drive pulse PCOM corresponds to a stage in which the volume of a cavity (pressure chamber) communicating with a nozzle is increased to pull in ink (which may be expressed as pull in meniscus, from the viewpoint of the ink-jetted surface), while a fall time of the drive pulse PCOM corresponds to a stage in which the volume of a cavity is decreased to push the ink out (which may be expressed as push out meniscus, from the viewpoint of the ink-jetted surface). As a result of the push-out of ink, ink drops are jetted through the nozzle. A change of the voltage gradient or peak voltage of a drive pulse PCOM having the trapezoidal waveform allows the amount of ink to be pulled in, the speed to pull in the ink, the amount of ink to be pushed out, and the speed to push out the ink to be changed, which changes the amount of ink drops to be jetted so as to gain different sizes of ink dots.

Figure 4:
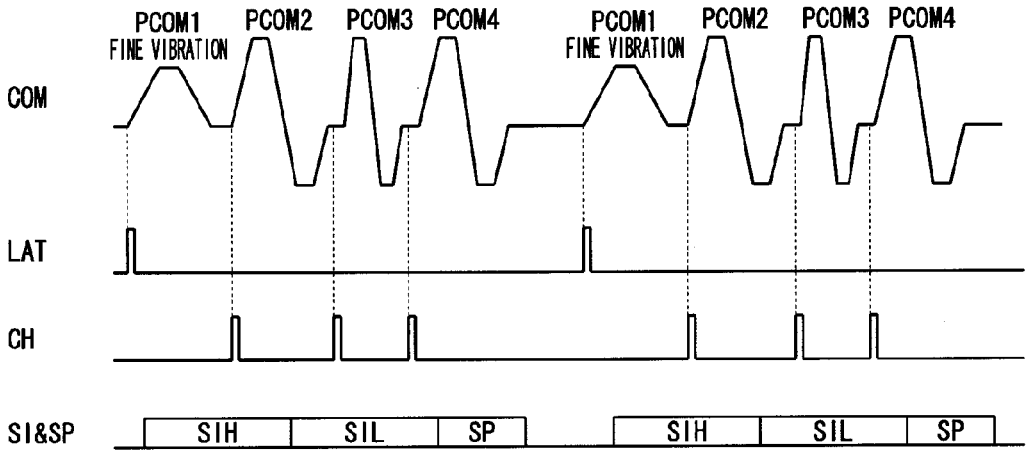
FIG. 4 is a diagram illustrating a drive signal structured by connecting drive pulses in time series.

Therefore, when a plurality of different drive pulses PCOM are sequentially connected in time to generate a series of drive signals COM as shown in FIG. 4, a single drive pulse PCOM may be selected from the signals to be supplied to the actuator 22 such as a piezoelectric element for one jet of an ink drop, or a plurality of drive pulses PCOM may be selected to be supplied to the actuator 22 such as piezoelectric elements for multiple jets of ink drops, thereby various sizes of ink dots can be formed. That is, if a plurality of ink drops is dripped at the same position while the ink is not dried up, the same result can be substantially obtained as in the case where a large ink drop is jetted, and the size of an ink dot can be increased. Such a combination of techniques enables a multi-level tone to be accomplished. The drive pulse on the left end of FIG. 4 only pulls in ink, and does not push out ink. This is called fine vibration which is used to inhibit or prevent a nozzle from being dried without jet of ink drops.

As a result, the following are input to the ink jet heads 2 and 3: the modulated signal data DATA; a drive pulse selection data SI&SP which selects a nozzle for jet of ink drops based on print data and determines a timing of connection of an actuator such as a piezoelectric element to the drive pulse PCOM; a latch signal LAT and a channel signal CH which connect the drive pulse PCOM and the actuators of the ink jet heads 2 and 3 based on the drive pulse selection data SI&SP after nozzle selection data is input to all of the nozzles; and a clock signal SCK which transmits the drive pulse selection data SI&SP as a serial signal to the ink jet heads 2 and 3. The drive pulse selection data SI&SP corresponds to the print data of the present invention. The actuators 22 such as piezoelectric elements of the ink jet heads 2 and 3 are connected in parallel relative to the drive pulse PCOM, and selection switch 201 is provided to each of the actuators 22.

Figure 5:
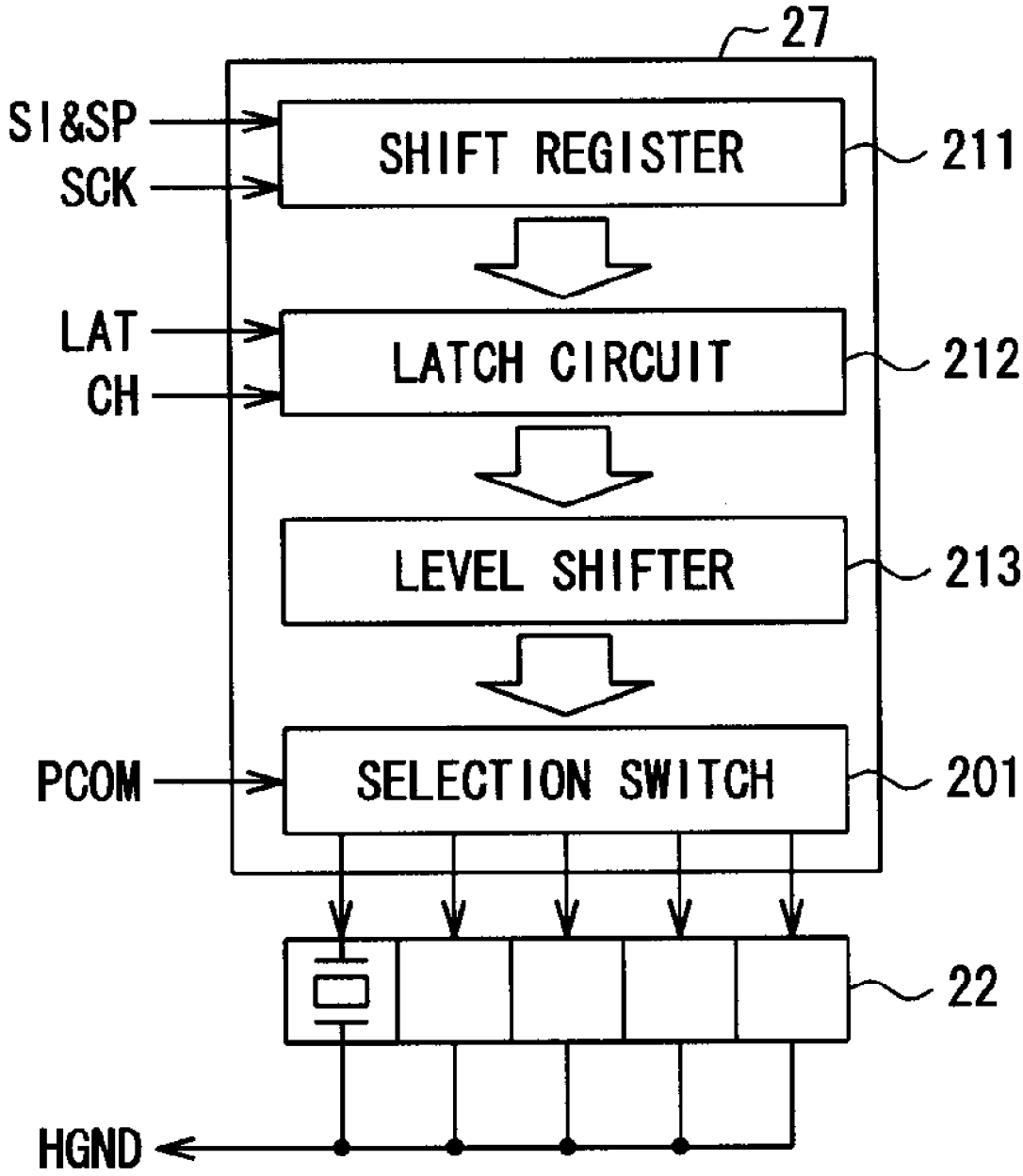
FIG. 5 is a block diagram illustrating the selector of FIG. 2.

FIG. 5 is a block diagram of a selector 27 for connecting the above described drive pulse PCOM to an actuator 22 such as a piezoelectric element. The selector 27 is configured with: a shift register 211 for saving drive pulse selection data SI&SP to specify an actuator such as a piezoelectric element corresponding to a nozzle through which ink drops are jetted; a latch circuit 212 for temporarily saving data of the shift register 211; a level shifter 213 for converting a level of an output of the latch circuit 212; and a selection switch 201 for connecting a drive pulse PCOM to an actuator 22 such as a piezoelectric element in response to an output of the level shifter.

To the shift register 211, drive pulse selection data SI&SP are sequentially input, and also a storage area thereof is sequentially shifted from a first stage to a subsequent stage in response to an input pulse of a clock signal SCK. After drive pulse selection data SI&SP for the number of nozzles is stored in the shift register 211, the latch circuit 212 latches each output signal of the shift register 211 according to an input latch signal LAT. The level of a signal saved in the latch circuit 212 is converted into a voltage level which enables a turning on/off of the selection switch 201 in a next stage by the level shifter 213. This operation is required because the drive pulse COM has a voltage higher than an output voltage of the latch circuit 212, and accordingly the selection switch 201 is set to operate at a high operating voltage range. Thus, the actuator 22 such as a piezoelectric element in which the selection switch 201 is closed by the level shifter 213 is connected to the drive pulse PCOM at a timing to connect the drive pulse selection data SI&SP. After the drive pulse selection data SI&SP of the shift register 211 is saved in the latch circuit 212, next print data is input to the shift register 211, and data saved in the latch circuit 212 is sequentially updated at a timing to jet ink drops. Reference character HGND in the figure denotes a ground terminal of the actuator such as a piezoelectric element. According to the selection switch 201, an input voltage of the actuator 22 is maintained at the voltage just before the actuator such as a piezoelectric element is separated from the drive pulse PCOM even after the separation.

Figure 6:
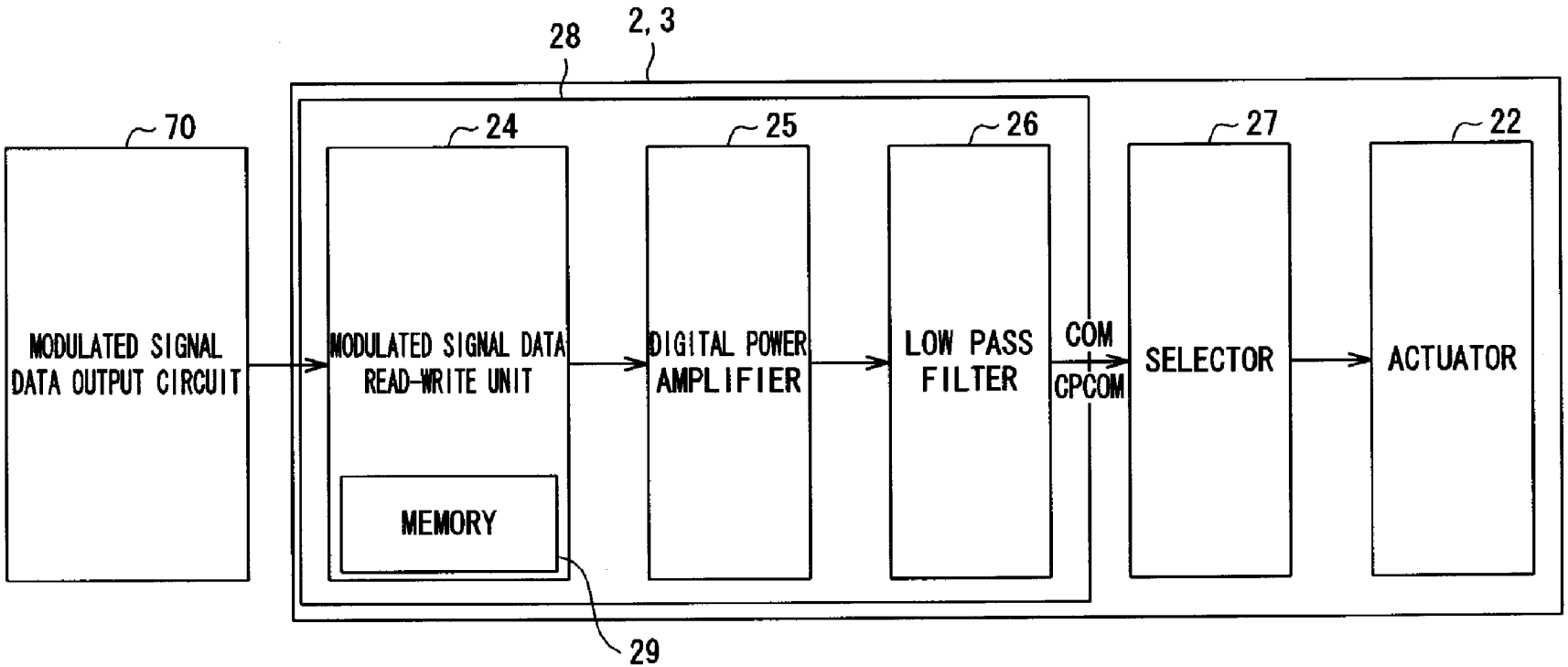
FIG. 6 is a block diagram of an overall configuration of the drive pulses output circuit of FIG. 2.

Next, the detail of a drive pulse output circuit 28 for creating and outputting a drive pulse PCOM in the present embodiment will be explained below. FIG. 6 shows an overall configuration of the drive pulse output circuit 28 and the selector 27 interposed between the modulated signal data output circuit 70 and the actuator 22 such as a piezoelectric element. The drive pulse output circuit 28 is configured to include: a modulated signal data read-write unit 24 which stores digital data DATA of a modulated signal output from the modulated signal data output circuit 70 into a memory 29 and reads out the digital data DATA of a modulated signal stored in the memory 29 to output a pulse width modulated signal; a digital power amplifier 25 which power amplifies a pulse width modulated signal output from the modulated signal data read-write unit 24; and a low pass filter 26 which removes a high frequency element of the amplified digital signal, which is power-amplified by the power amplifier 25, for smoothing, so as to output a drive pulse PCOM.

Figure 7:
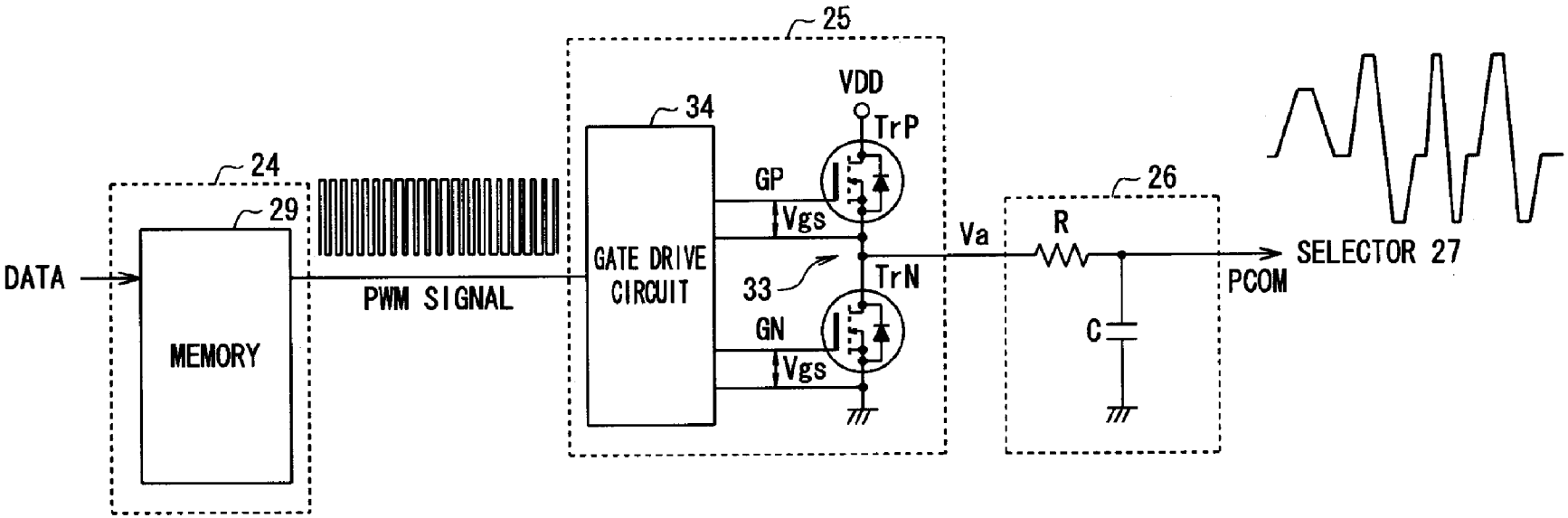
FIG. 7 is a block diagram specifically illustrating the drive pulses output circuit of FIG. 6.

FIG. 7 shows a specific structure from the modulated signal data read-write unit 24 to the low pass filter 26 of the drive pulse output circuit 28. The modulated signal data read-write unit 24 stores the digital data DATA of a modulated signal output from the modulated signal data output circuit 70 in the memory 29, and also reads out once the modulated signal digital data DATA stored in the memory 29 at a short sampling period to convert the data into a pulse width modulated signal. Therefore, after the read out of the modulated signal digital data DATA stored in the memory 29, the data needs to be processed with a high frequency, but as will be explained later, since the storage of the modulated signal digital data DATA is implemented prior to the creation and output of a drive pulse, the data may be processed with a low frequency without any problem. The modulated signal may be a pulse density modulated (PDM) signal instead of a pulse width modulated (PWM) signal.

Figure 8:
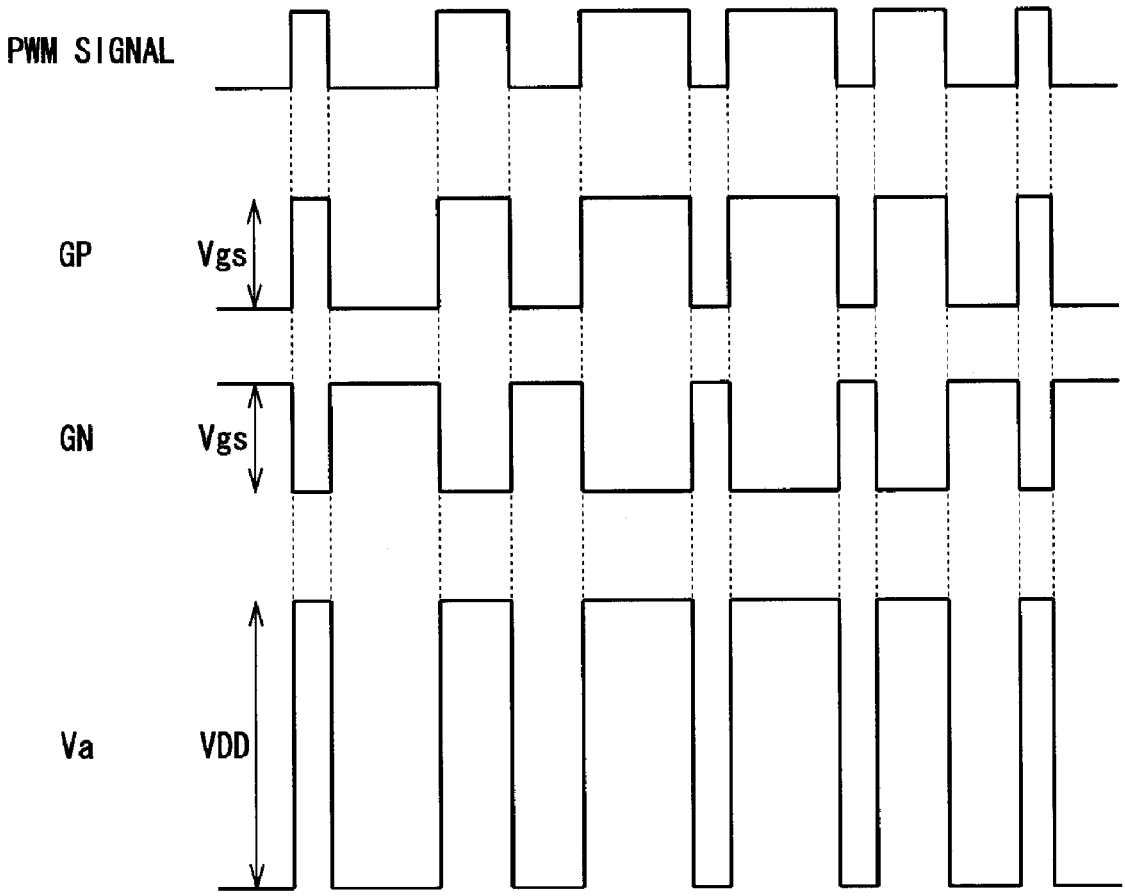
FIG. 8 is a diagram illustrating an action of the digital power amplifier of FIG. 7.

The digital power amplifier 25 is configured with a half bridge driver stage 33 including both MOSFETTrP and TrN which substantially amplify power, and a gate drive circuit 34 for modifying the gate-source signals GP and GN of the MOSFETTrP and TrN based on a modulated (PWM) signal from the modulated signal data read-write unit 24, and the half bridge driver stage 33 is a push-pull combination of the high-side MOSFETTrP and the low-side MOSFETTrN. FIG. 8 shows the changes of GP, GN and Va in response to a pulse width modulated signal, where GP is gate-source signal of the high-side MOSFETTrP, GN is gate-source signal of the low-side MOSFETTrN, and Va is output of the half bridge driver stage 33. The gate-source signals GP and GN of the MOSFETTrP and MOSFETTrN have a sufficient voltage value Vgs to turn ON the MOSFETTrP and MOSFETTrN, respectively.

With a pulse width modulated signal at Hi level, the gate-source signal GP of the high-side MOSFETTrP is at Hi level and the gate-source signal GN of the low-side MOSFETTrN is at Lo level. Thus, the high-side MOSFETTrP is turned into an ON state and the low-side MOSFETTrN is turned into an OFF state. As a result, the output Va from the half bridge driver stage 33 is turned to be a supply power VDD. Meanwhile, with a pulse width modulated signal at Lo level, the gate-source signal GP of the high-side MOSFETTrP is at Lo level, and the gate-source signal GN of the low-side MOSFETTrN is at Hi level. Thus, the high-side MOSFETTrP is turned into an OFF state and the low-side MOSFETTrN is turned into an ON state. As a result, the output Va from the half bridge driver stage 33 becomes 0.

The output Va from the half bridge driver stage 33 of the digital power amplifier 25 is supplied as a drive pulse PCOM to the selection switch 201 via the low pass filter 26. The low pass filter 26 is configured with a primary RC low-pass filter including a combination of one resistor R and one capacitor C. The low pass filter 26 having the low-pass filter is designed to sufficiently attenuate a high-frequency component of an output Va from the half bridge driver stage 33 of the digital power amplifier 25, and not to attenuate a drive pulse PCOM component.

As described above, when the MOSFETTrP and TrN of the digital power amplifier 25 are digitally driven, the MOSFETs operate as switch elements so that currents flow into the ON-state MOSFETs. However, a drain-source resistance value is very small, and hence almost no power loss is generated. On the other hand, no current flows into the OFF-state MOSFETs, thereby no power loss is generated. Thus, the power loss of the digital power amplifier 25 is extremely small, as the result of that small MOSFETs can be used, and a cooling unit such as a cooling plate radiator can be eliminated. While a transistor is linearly driven at an efficiency of about 30%, a digital power amplifier can be driven at an efficiency of 90% or more. In addition, since one transistor requires a cooling plate radiator of 60 mm square, the elimination of such a cooling plate radiator provides a distinct advantage in an actual layout. In the present embodiment, this advantage is utilized to mount the drive pulse output circuit 28 itself to the ink jet heads 2 and 3.

Figure 9:
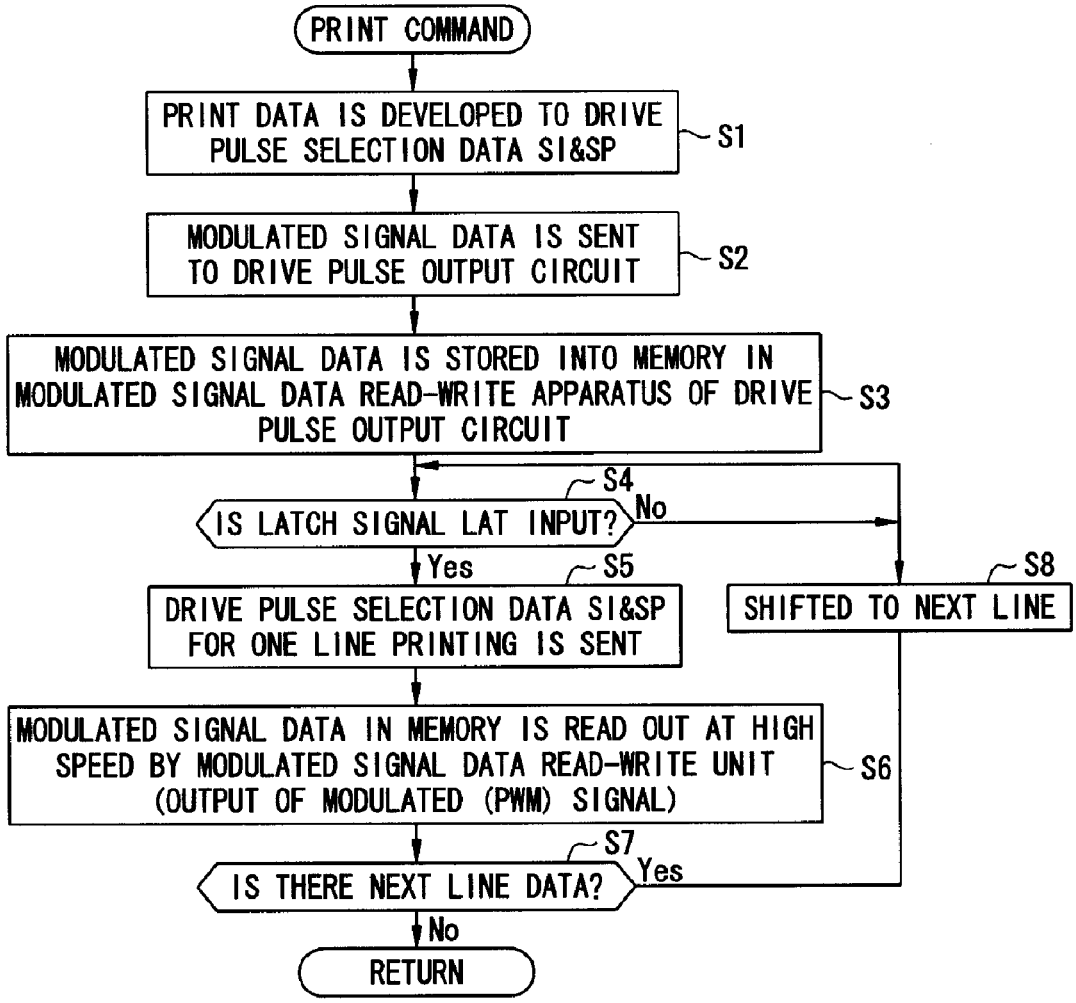
FIG. 9 is a flowchart of a calculation processing upon a print command at the control unit of FIG. 2.

Next, a calculation processing executed in the control unit 62 to appropriately select four drive pulses, that is a first drive pulse PCOM 1 to a fourth drive pulse PCOM to be supplied to actuator of nozzles through which ink drops are jetted for printing will be explained below with reference to the flowchart of FIG. 9. The calculation processing is executed in response to a printing command from a host computer 60, and first at Step S1, print data which is received from the host computer is developed to the drive pulse selection data SI&SP.

Then, the processing goes to Step S2, where modulated signal digital data DATA is output from the modulated signal data output circuit 70 to the drive pulse output circuit 28.

Next, the processing goes to Step S3, where the modulated signal digital data DATA is stored into the memory 29 in the modulated signal data read-write unit 24 of the drive pulse output circuit 28.

Next, the processing goes to Step S4, where it is determined if a latch signal LAT is input or not, and if so, the processing goes to Step S5, and if not, the processing stops there.

At Step S5, the drive pulse selection data SI&SP for one line printing is sent.

Then, the processing goes to Step S6, where the modulated signal digital data DATA in the memory 29 is read out at a high speed by the modulated signal data read-write unit 24 to output a pulse width modulated (PWM) signal.

Then, the processing goes to Step S7, where it is determined if there exists a next line data or not, and if so, the processing goes to Step S8, and if not, the processing returns to the main program.

At Step S8, after the line to be printed is shifted to the next, the processing goes to Step S4.

According to the calculation processing, prior to the sending of drive pulse selection data SI&SP for one line printing, and the high-speed read-out of the modulated signal digital data DATA, that is the creation and output of a drive pulse PCOM, modulated signal digital data DATA is output from the modulated signal data output circuit 70, which is stored in the memory 29 of the drive pulse output circuit 28 in the modulated signal data read-write unit 24, thereby the output and storage into the memory 29 of the modulated signal digital data DATA do not need any high frequency such as a pulse width modulated signal, but can be implemented with a low frequency. Since the control apparatuses such as the control unit 62 and the head driver 65 are provided in the body of the ink jet printer, and the components from the drive pulse output circuit 28 to actuator 22 are provided in the ink jet heads 2 and 3, the wiring which couples between them, that is, the transmission path of modulated signal digital data DATA is relatively long. However, the transmission of modulated signal digital data DATA can be implemented with a low frequency as described above, which makes the transmission easy. Meanwhile, the transmission path in the drive pulse output circuit 28 mounted to the ink jet heads 2 and 3 is extremely short, which causes little power loss, and enables a transmission of a pulse width modulated signal and a drive pulse with a high frequency.

As described above, according to a head driving method of an ink jet printer and a head drive apparatus of the present embodiment, a modulated signal is output after a pulse modulation based on the modulated signal data DATA which is stored in a storage unit such as a memory 29, the modulated signal is power-amplified by the digital power amplifier 25, and the amplified digital signal is smoothed to be output to the actuator 22 such as a piezoelectric element as a drive signal, thereby the digital power amplifier 25 having a high amplification efficiency efficiently amplifies the power of the modulated signal. As a result, a cooling unit such as a cooling plate radiator of a transistor can be eliminated, the drive pulse output circuit 28 can be mounted to the ink jet heads 2 and 3, and so the transmission path of an actuator drive pulse can be shortened, which inhibits or prevents any waveform distortion of the drive pulse. Moreover, in the processing, modulated signal data DATA required to generate a drive pulse is output and stored in a memory, which is used to create and output a modulated signal. Therefore, the transmission of the modulated signal data DATA can be implemented with a low frequency prior to the creation and output of a drive pulse, and a high frequency modulated signal can be transmitted without any loss using the drive pulse output circuit mounted to the ink jet head, which makes the signal transmission form appropriate.

In the above described embodiments, only the example in which a head drive apparatus of an ink jet printer of the present invention is applied to a line head ink jet printer has been explained in detail, but a head drive apparatus of an ink jet printer of the present invention can be applied to any type of ink jet printer including a multi-pass printer.

What is claimed is:

1. A method for driving an ink jet head of an ink jet printer, said ink jet head having a nozzle for jetting liquid drops, and an actuator provided in correspondence to the nozzle, the method comprising:

outputting, by a modulated signal data output circuit, a modulated signal data;

outputting, by a drive pulse output circuit, a drive pulse to the actuator based on the modulated signal data;

the step of outputting the drive pulse comprising:

storing, by a storage unit, the modulated signal data in a memory;

reading out, by a modulated signal data read-write unit, the modulated signal data from the memory and pulse-modulating the modulated signal data to output a pulse modulated signal;

power-amplifying, by a digital power amplifier, the pulse modulated signal; and smoothing, by a low pass filter, the pulse modulated signal power-amplified in the power-amplifying step to output the pulse modulated signal to the actuator as the drive pulse.

2. A head drive apparatus of an ink jet printer, comprising:

a modulated signal data output circuit that outputs a modulated signal data; and an ink jet head comprising:

a plurality of nozzles that jet liquid drops that are provided for an ink jet head;

a drive pulse output circuit that outputs a drive pulse to the actuators based on the modulated signal data output from the modulated signal data output circuit, and wherein the drive pulse output circuit comprises:

a storage unit that stores the modulated signal data output from the modulated signal data output circuit;

a modulated signal data read-write unit that reads out the modulated signal data stored in the storage unit and pulse-modulates the modulated signal data to output a pulse modulated signal;

a digital power amplifier that power-amplifies the pulse modulated signal output from the modulated signal data read-write unit; and a low pass filter that smoothes the pulse modulated signal power-amplified by the digital power amplifier to output the pulse modulated signal to the actuators as a drive pulse.

3. An ink jet printer, comprising the head drive apparatus according to claim 2.

* * * * *